US008764234B1

(12) United States Patent
Acree et al.

(10) Patent No.: US 8,764,234 B1
(45) Date of Patent: Jul. 1, 2014

(54) DECORATIVE SPHERE

(71) Applicants: Donald V. Acree, Atlantic Beach, NC (US); Anthony J. Ferguson, Waxhaw, NC (US); Geoffrey H. Harris, Chicago, IL (US)

(72) Inventors: Donald V. Acree, Atlantic Beach, NC (US); Anthony J. Ferguson, Waxhaw, NC (US); Geoffrey H. Harris, Chicago, IL (US)

( * ) Notice: Subject to any disclaimer, the term of this patent is extended or adjusted under 35 U.S.C. 154(b) by 6 days.

(21) Appl. No.: 13/723,352

(22) Filed: Dec. 21, 2012

(51) Int. Cl.
*F21V 21/00* (2006.01)

(52) U.S. Cl.
USPC ..... 362/249.01; 362/249.04; 362/808; 362/809

(58) Field of Classification Search
None
See application file for complete search history.

(56) References Cited

U.S. PATENT DOCUMENTS

| | | | | |
|---|---|---|---|---|
| 5,876,111 | A * | 3/1999 | Wu | 362/249.16 |
| 6,386,734 | B1 * | 5/2002 | Huang | 362/249.09 |
| 6,401,404 | B1 * | 6/2002 | Fillipp et al. | 52/80.1 |
| 6,443,595 | B1 * | 9/2002 | Tseng | 362/249.07 |
| 2002/0141184 | A1 * | 10/2002 | Shieh | 362/252 |
| 2009/0196052 | A1 * | 8/2009 | Fremont | 362/352 |

* cited by examiner

*Primary Examiner* — Ali Alavi
(74) *Attorney, Agent, or Firm* — Coats and Bennett PLLC

(57) ABSTRACT

A decorative sphere comprised of a series of generally D-shaped open panels pivotally connected together. In one configuration, the panels can be pivoted or moved to a folded and collapsed position for storage. In another configuration, the panels can be expanded and held in a spaced apart relationship to where the individual panels form a sphere. One or more strands of lights can be integrally incorporated into the sphere.

13 Claims, 2 Drawing Sheets

DECORATIVE SPHERE

FIELD OF THE INVENTION

The present invention relates to decorative structures, and more particularly to decorative structures that may have strands of lights incorporated therein or which are susceptible to strands of lights being incorporated.

BACKGROUND OF THE INVENTION

In recent years there has been a growing demand for lighted decorative structures. This is obvious during the Christmas season where it is not unusual to see significant numbers of lighted decorative structures being displayed around homes and buildings. Many of these lighted decorative structures are used only seasonal and for a relatively short period of time. This means that they have to be stored and from time-to-time moved back and forth between storage and outdoor placement, for example. Therein lies the problem. These lighted structures are difficult to handle when assembled and they consume a great deal of storage space. Indeed these are the very reasons that consumers do not purchase and use more decorative lighted structures.

There has been and continues to be a need to form different lighted decorative structures and to address the storage and handling problems that are inherent with them.

DESCRIPTION OF EXEMPLARY EMBODIMENT

Figure 1:
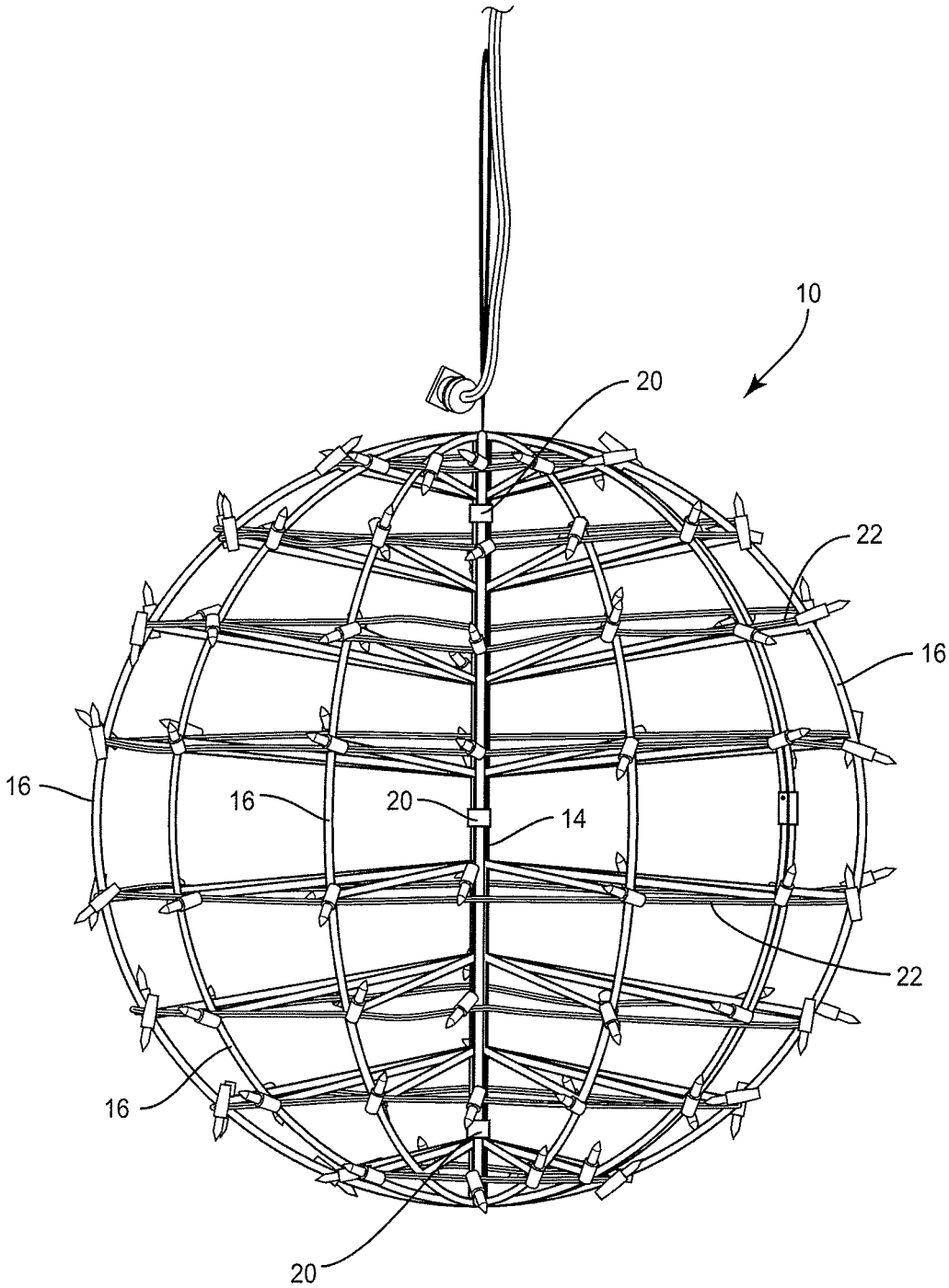
FIG. 1 is a side elevational view of a lighted decorative sphere.

With further reference to the drawings, the decorative device of the present invention is in the form of a sphere and is shown in the drawings and indicated generally by the numeral 10. As discussed herein, the sphere 10 can assume two configurations, a sphere as shown in FIG. 1 and a folded and collapsed configuration shown in FIG. 2.

The sphere 10 of the present invention includes a plurality of D-shaped open panels indicated generally by the numeral 12. Each D-shaped open panel 12 can be constructed of various materials such as plastic, metal, etc. The panels 12 are generally open and, as noted above, assume a general shape that is much like the shape of one form of the letter "D". The structure of each panel 12 comprises stock that in one embodiment is round. The sphere 10 can include three or more panels.

Viewing an individual D-shaped open panel 12, the same includes a first side 14. The first side 14 is a straight element that includes opposed end portions. A second side of the D-shaped open panel is referred to by the numeral 16. The second side is curved and joins opposed end portions of the first side 14. Thus it is seen that the combined effect of the first side 14 and the second side 16 is to form the general shape of the open panel 12.

Each D-shaped open panel includes a plurality of spaced apart members 18 that extend between the first side 14 and the second side 16. This is particularly shown in FIG. 2. Members 18 provide structural rigidity to each D-shaped open panel 12.

The individual D-shaped open panels 12 are connected together. Various means can be used to connect the individual panels 12 together. In the embodiment illustrated herein, there is provided one or more connectors 20 that connect the first side 14 of the respective panels 12 together. Again, various types of connectors 20 can be utilized. In one embodiment, the connectors 20 may include a series of flexible ties. Shown here as an exemplary embodiment, is a series of connectors 20 in the form of clasps. The connectors 20 provide for two functions. First, the connectors 20 allow the individual panels 20 to be rotated or moved with respect to each other. Second, the connectors 20 are designed such that they can secure the respective panels 12 in a relatively stationary position with respect to each other, as seen in FIG. 1, where the D-shaped open panels 12 assume the sphere. The connectors 20 hold the individual panels 12 in place so that the shape of the sphere is maintained. As will be discussed later, it is useful for the panels 12 to assume a folded position. Hence, the connectors 20 allow for the panels to rotate with respect to each other so as to assume a folded position (FIG. 2).

In the embodiment illustrated herein, as noted above, the connectors are in the form of clasps. The clasps 20 can be positioned in one of two positions. In the first position, the clasp extends around a series of first sides 14 but enables the individual panels to rotate or move with respect to each other. In the second position, the connector 20 is designed to secure the individual panels in place with respect to each other. For example, in FIG. 1, the connector 20 secures the individual panels 12 such that they are spaced apart from each other and such that as a whole they form the sphere 10.

The sphere 10 also includes one or more strings of lights 22. The string of lights can be integral with the sphere and form a part thereof or the sphere can be designed to receive and support one or more strings of lights. In the embodiment illustrated herein, the string of lights 22 is integral with the structure of the sphere. That is, the one or more string of lights 22 is interconnected between a plurality of the D-shaped open panels 12. The one or more string of lights may be connected to all panels or to selected panels. In addition, the string of lights, in an integral embodiment, is connected such that the lights do not encumber the folding of the D-shaped panels towards the collapsed position or encumber the movement of the panels as they are moved from the collapsed position shown in FIG. 2 to the position where the panels form the sphere in FIG. 1. Note that the string of lights, in one embodiment, are secured such that when the sphere 10 assumes the position shown in FIG. 1 that the individual strings extend generally horizontally around the sphere 10. Also note that the string of lights 22 are attached and spaced such that when the panels 12 are expanded to form the sphere 10 that the string itself tends to become integrated into the structure of the sphere and do not detract esthetically from the sphere.

Figure 2:
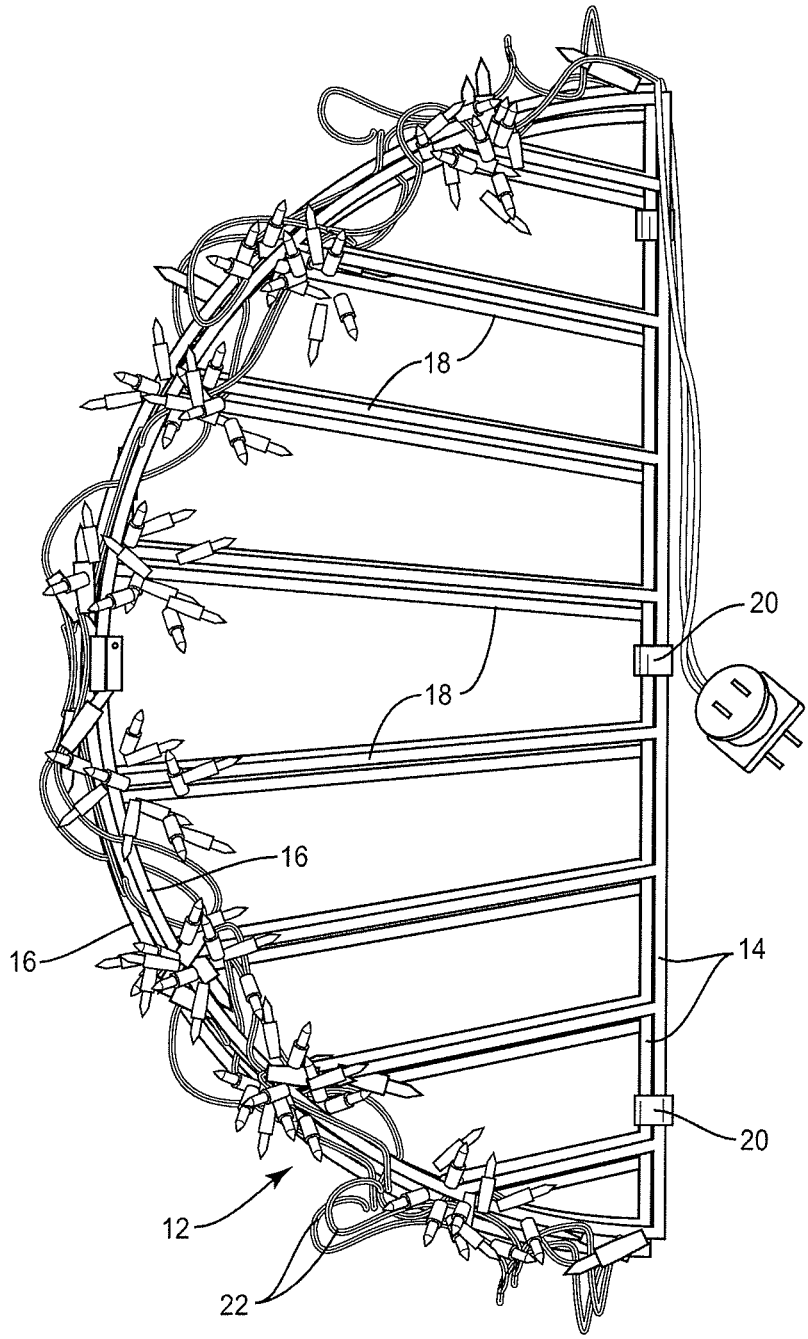
FIG. 2 is a view showing the lighted sphere in a folded and collapsed position.

As discussed above, one feature of the present invention is that the sphere 12 is configurable from a folded and collapsed position such as shown in FIG. 2 to an expanded position shown in FIG. 1 where the panels form the sphere 10. In the folded position, the individual panels 12 lie in side-by-side relationship. The panels 12 in this configuration lie closely adjacent each other to form a collapsed and compact configuration that makes it easy for the sphere to be stored. It is appreciated that in the collapsed position shown in FIG. 2 that the D-shaped open panels form a relatively thin unit. When in the folded configuration, the connectors 20 can be adjusted or positioned so as to secure the panels together such that the first sides 14 are generally tightly held. This maintains the individual panels 12 in a compact unitary configuration.

In the configuration shown in FIG. 1, the panels 12 are spaced apart, preferably evenly spaced. The second side 16 of the respective panels 12 form points or lines that form a part of the outer areas of the sphere 10. The first sides 14 are joined together or held together by the connectors 20. Here the connectors 20 are used to effectively clasp the individual first sides 14 and to hold them together such that the respective panels 12 are held in a generally fixed or stationary position such that they contribute uniformly to forming the sphere 10.

Therefore, based on the foregoing specification and description, it is appreciated that the present invention presents a decorative sphere that can easily be transformed from the collapsed or folded position shown in FIG. 2 to an operative and useable position shown in FIG. 1. The design of the sphere is simple and relatively inexpensive to manufacture and assemble. When transformed or formed into the sphere, FIG. 1, the design presents a unique structure for a decorative element. When the one or more light strands 22 are incorporated into the design, this means that the user does not have to go to the time and trouble of restringing the lights each time that the decorative structure is used. This is because in an integral embodiment, the one or more strands of lights 22 is integral with the D-shaped open panels 12 even when the panels assume the folded and collapsed position of FIG. 2.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A decorative and folding sphere comprising:

a series of generally D-shaped open panels;

each D-shaped open panel including an elongated generally straight first side and a curved second side that joins opposed ends of the first side and wherein the first and second sides form the generally D-shaped open panel;

one or more connectors for connecting the first sides of the D-shaped open panels together;

the connector permitting the first side of the D-shaped open panels to rotate within the connector;

wherein the D-shaped open panels are moveable while being connected together from a folded and generally collapsed position to an expanded position wherein the expanded position the D-shaped open panels are spaced apart and form a sphere;

wherein when forming the sphere, the first sides of the D-shaped open panels extend in side-by-side relationship and form a central axis of the sphere; and one or more strands of lights connected to a plurality of the D-shaped open panels and wherein when the panels form the sphere, the one or more strands of lights extend from one panel to another panel and wherein the one or more strands of light extend over a substantial area of the sphere.

2. The decorative and folding sphere of claim 1 wherein the connector assumes two configurations, a first configuration that permits the first sides of the panels to rotate between the folded and collapsed position and the extended position, and a second configuration that secures the D-shaped open panels in a generally stationery position with respect to each other.

3. The decorative and folding sphere of claim 1 wherein each D-shaped open panel includes a series of members that are interconnected between the first side and the second side of each D-shaped open panel.

4. The decorative and folding sphere of claim 3 wherein the members interconnected between the first and second sides are spaced apart.

5. The decorative and folding sphere of claim 1 wherein there is provided a flexible connector for suspending the formed sphere, and wherein when the sphere is suspended, the flexible connector extends from a point on an upper portion of the sphere that is generally aligned with the axis of the sphere.

6. The decorative and folding sphere of claim 1 wherein the one or more connectors comprise one or more flexible ties that extend around the first sides of the D-shaped open panels.

7. The decorative and folding sphere of claim 1 wherein the one or more connectors comprises one or more clasps with each clasp extending around the first sides of a plurality of D-shaped open panels and operative to permit the panels to rotate with respect to each other or to secure the panels in a position such that the panels are spaced from one another and form the sphere.

8. A decorative sphere that can be transformed from a folded and collapsed position to an expanded position where a sphere is formed, comprising:

a series of panels with each panel including an inner side and a curved outer side;

one or more connectors for connecting the panels together, the connectors engaging the inner side of the panels and in one mode permitting the panels to move with respect to each other and in a second mode securing the panels together such that the panels are generally held together in a generally fixed position; and wherein the decorative sphere is configured to assume first and second positions wherein in the first position the individual panels are disposed in a folded and collapsed position and lie in side-by-side relationship to each other and form a relatively thin unit structure, and in the second position the panels are expanded and spaced apart and are held in a spaced apart position by the one or more connectors and in the second position the curved outer sides of the panels form the sphere.

9. The decorative sphere of claim 8 including one or more strands of lights are integral with the sphere and wherein the one or more strands of lights are interconnected between a plurality of the panels.

10. The decorative sphere of claim 9 wherein each panel includes a generally D-shaped open panel and wherein the inner side of each panel includes an elongated member having opposed end portions and wherein the curved outer side extends from opposed end portions.

11. The decorative sphere of claim 10 wherein the one or more connectors include one or more clasps with each clasp being designed to permit the panels to rotate and move with respect to each other and further wherein the clasps are designed to secure the panels together in a generally fixed position.

12. The decorative sphere of claim 8 wherein there is provided a series of strands of lights connected between respective panels and wherein the strands of lights extends generally horizontally around portions of the sphere.

13. The decorative sphere of claim 10 wherein the inner sides of the respective panels are grouped together and extend in side-by-side relationship and form a central axis of the formed sphere.

* * * * *